US005668782A

United States Patent [19]

Crawford

[11] Patent Number: 5,668,782

[45] Date of Patent: Sep. 16, 1997

[54] PROGRAMMED MULTI TIME INTERVAL PIN

[76] Inventor: Jack F. Crawford, 5 Sea Shore Dr., Ormond Beach, Fla. 32176

[21] Appl. No.: 523,693

[22] Filed: Sep. 5, 1995

[51] Int. Cl.[6] ..... G04F 8/00

[52] U.S. Cl. ..... 368/107; 116/309; 368/110

[58] Field of Search ..... 116/308, 309, 116/310, 311; 368/89–113, 10

[56] References Cited

U.S. PATENT DOCUMENTS

| | | | |
|---|---|---|---|
| 2,161,372 | 6/1939 | Mihalyi | 116/309 |
| 2,470,582 | 5/1949 | Seasongood | 116/309 |
| 3,025,827 | 3/1962 | Shaar | 116/309 |
| 3,187,319 | 6/1965 | Crawford | 368/107 |
| 3,619,594 | 11/1971 | Morez | 116/309 |
| 3,852,900 | 12/1974 | Svec | 116/309 |
| 4,920,912 | 5/1990 | Kirkling | 116/309 |

FOREIGN PATENT DOCUMENTS

| | | | |
|---|---|---|---|
| 484468 | 7/1952 | Canada | 116/309 |
| 372385 | of 1939 | Italy | 116/309 |

OTHER PUBLICATIONS

Laboratory Medicine: Official Pub. of Am. Soc. Clinical Pathologists; Feb. 1975, vol. 6, No. 2.

Detection of Diabetes, Jos. Kraft, MD pp. 10–19.

Disorders of Glucose Metabolism: Nelson Watts MD, ASCP Press, #2362, 1987.

Clinical Lab. Medicine, Richard Ravel MD, Yearbook Med. Pub., 1973.

Clinical Lab. Tests Spring hous Pub. Oral Glucose Tolereueit. pp. 301–306., 1995.

Diagnostic Test Prof. Handbook, p. 168, 1995.

*Primary Examiner*—Bernard Roskoski

*Attorney, Agent, or Firm*—Paul S. Rooy

[57] ABSTRACT

A multi time interval pin comprising a cap rotatably attached to, and a pin rigidly attached to, a carrier base. The cap comprises a window wherethrough indicia on a carrier base upper surface is legible. The carrier base further comprises a carrier base lower surface with a carrier base projection extending perpendicularly from the carrier base lower surface. The pin also extends perpendicularly from the carrier base lower surface, such that the pin and the carrier base projection are approximately parallel. The pin, carrier base lower surface, and carrier base projection define an anti-rotation notch whereby the multi time interval pin may be prevented from rotating relative to a timer disc in which it is installed when the cap is rotated relative to the carrier base.

4 Claims, 3 Drawing Sheets

FIG 1
PRIOR ART
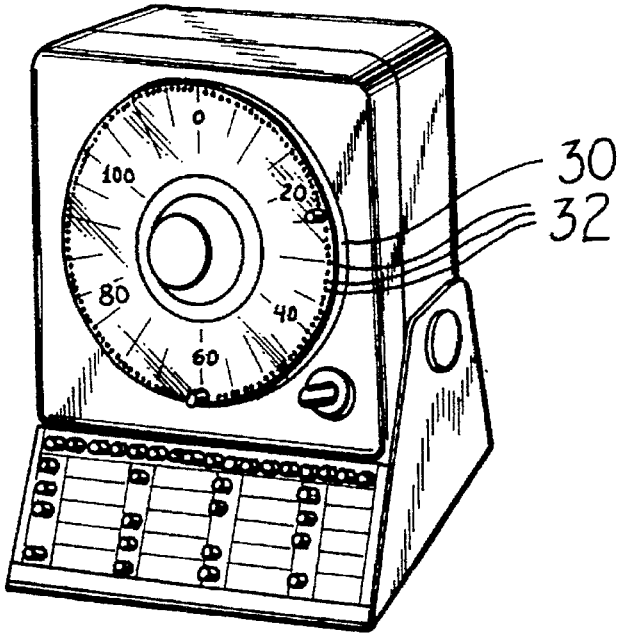
34
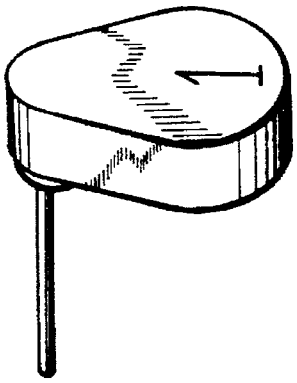
FIG 2
PRIOR ART

FIG 3
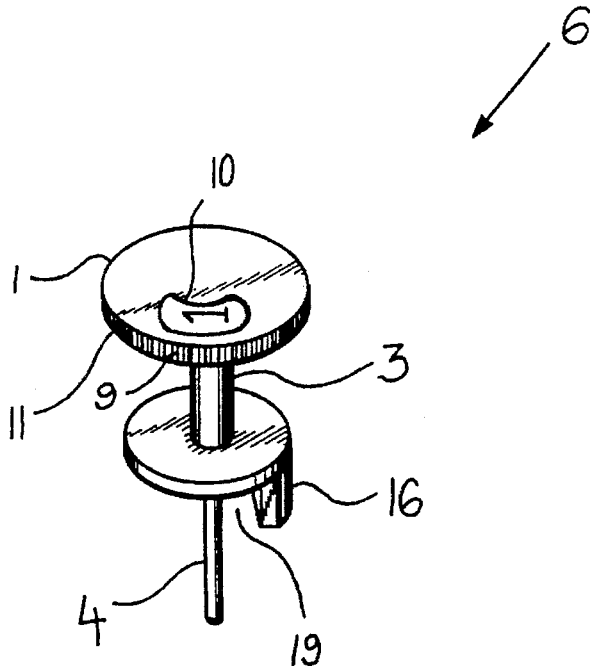
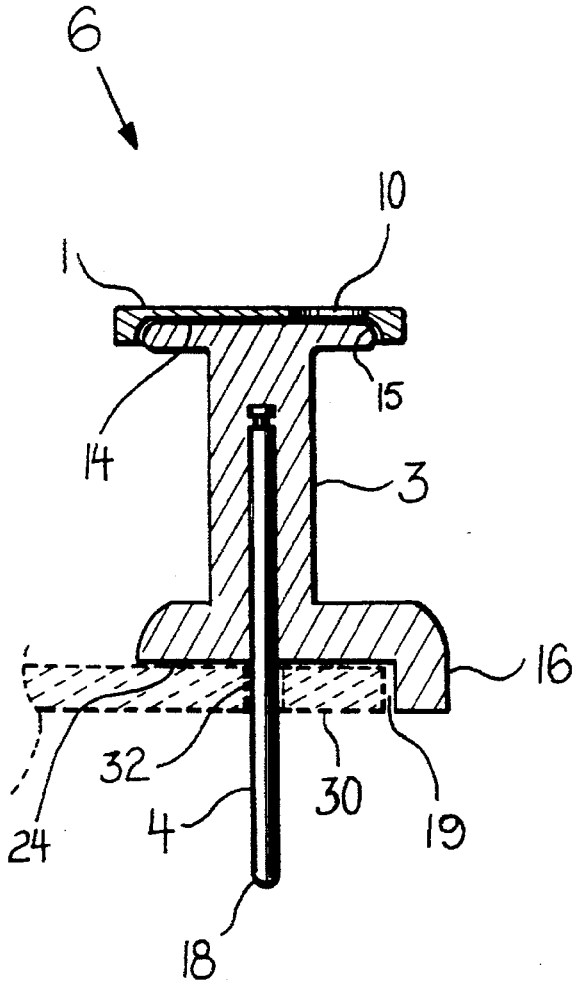
FIG 4

FIG 5
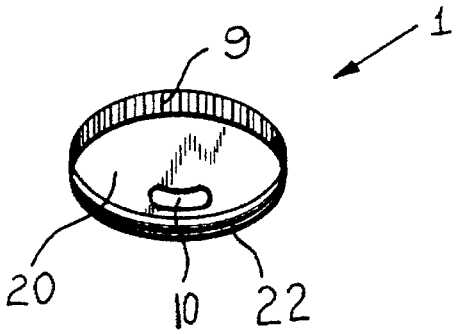
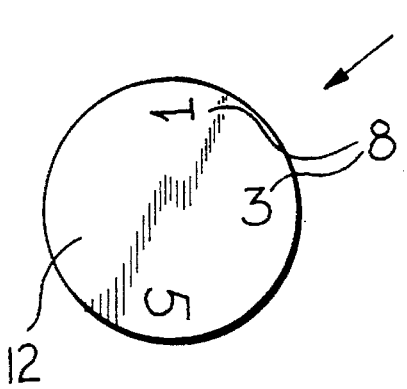
FIG 6
FIG 7
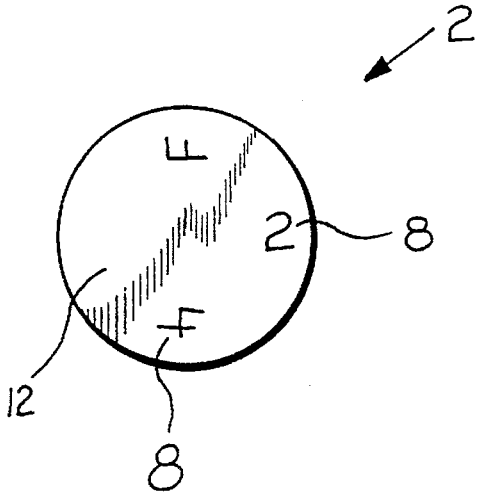

PROGRAMMED MULTI TIME INTERVAL PIN

BACKGROUND OF THE INVENTION

1. Field of the Invention

The present invention relates to mechanically operated Multi-Interval Timers, specifically to timing pins used to control multiple, sequential intervals.

2. Description of the Prior Art

Reference is made to the single interval pins used in the first Multi-Timer, U.S. Pat. No. 3,187,319, in order that the new invention, the PROGRAMMED MULTI-TIME INTERVAL PIN, may be completely understood and appreciated in the proper context. FIGS. 1 & 2 show the features of the Multi-Timer. The unit contains a motor which drives a timer disc 30 counterclockwise, in two hour continuous cycles. The disc 30 has a circle of 120 disc holes 32, evenly spaced one minute apart, around the 360 degree periphery. A disk hole 32 has a rotary speed of 3 degrees per minute. The timer disc 30 rotates over a clock face numbered clockwise in the same one minute intervals, beginning with zero at the top of the face and ending at 120 minutes (2 hrs.), also the zero unit. A single interval pin 34 inserted into one of these disc holes 32 to select a desired time increment, sixty minutes for example, requires 60 minutes to count down to zero. If the single interval pin 34 is not removed, a new 2 hour timing increment begins with the next one-minute space. That means, each minute a 120 minute count-down ends and a new one begins. As a result, there are always 120 individual disc holes 32 available, in a descending order of value, for selection.

The single interval pin 34 was designed in a tear drop shape, with the pin molded into the plastic at the narrow end, so that it would occupy just one disc hole 32 space, leaving adjacent holes available to other single interval pins 34. The broader opposite end is flattened to provide space for the code numbers. FIGS. 1 & 2 illustrate this original system.

Multi-Timer Pins are single interval pins used to select any time interval up to two hours, in one minute intervals. There are four sets of five pins, numbered from 1 to 5. Each set is color coded red, yellow, blue or green. These pins reside in a Monitor Panel that is divided into four sections with five subsections, each coded and numbered to correspond with the resident pin. The function of this panel is to correlate the pin with an instruction temporarily written on a white space adjacent to the resident pin. For operations routinely performed, the notation can remain, which temporarily reserves that pin and space. Refer to FIG. 1, which illustrates this description.

The first model under this patent was produced by Coulter Electronics, Inc.. The instructions for its used are as follows.

1. PROGRAM for a SINGLE TEST, or a single group of tests, using a single pin for a SINGLE TIME INTERVAL, follows the basic Monitor Panel Program described above. A single color coded, numbered pin selects a time interval which correlates with the instructions written in the similarly coded section on the panel.

2. PROGRAM for monitoring a SINGLE TEST which is started at variable short intervals, but all requiring the SAME TIME INTERVAL, as with the ESR (Sed. Rate) must use a single pin to represent the starting time of each patient. The Monitor Panel provides a black coded section of pins, sequentially numbered, each number to represent one patients selected starting time. The pin color identifies the test, each pin selects the same 1 hr. time interval when inserted and the pin number identifies the patient.

3. PROGRAM for monitoring a SINGLE TEST requiring MULTIPLE TIME INTERVALS, as with the OGTT, one color coded section of the Monitor Panel is assigned to each patient. The timing intervals are written in the five numbered subsections adjacent to each pin. The pin code numbers indicate the sample sequence. When each pin is inserted into the timing disc, the selected time interval is the one indicated on the panel. The pin color identifies the patient, the pin number refers to the sampling sequence and also refers back to the noted sampling time on the panel.

This invention is intended to address the problems discussed in the following statements. It is also intended to embrace any important elements mentioned.

The diagnostic significance of an oral glucose tolerance curve is dependent on the control of the many variables present in the collection of the timed, sequential blood samples that represent the patient's glucose level at each sample point. These variables are listed in order of occurrence.

1. Fasting state of patient should be verified.

2. Loading glucose dose should be drunk within 5 minutes, and the time finished and amount taken recorded (scale on bottle).

3. Time sample drawn must be recorded.

4. Rigid control of the accuracy of the sequential sample intervals.

Many patients have difficulty drinking the glucose solution and take a long time to finish. In our laboratory, patients are encouraged to finish within 5 minutes, however the additional time required after the sequential timing begins is recorded and the amount of glucose drank (scale on bottle) must be documented.

The time intervals need to be accurately controlled since the interpretation of the glucose tolerance curve is based on the blood glucose level at each specified sample interval from which the curve is made. The inevitable and variable time delays inherent with the venipuncture technique of collecting blood samples should be documented, so that the curve can be corrected. This correction is accomplished with both systems in different ways. The Programmed Multi-Time Interval pin can start the next interval, while counting down the last interval; the Single Interval Pin cannot.

The accuracy of the corrected curve is dependent upon the accuracy of the specified sample intervals. The single pin system is inadequate and in many instances, unable to provide integrated sample points. The Programmed Multi-Time Interval Pin, the present invention, is designed so that all the timed sample points are locked in simultaneously at the start of the test. Automatically the sample points are all sequentially related and all refer to the same starting point.

The patient preparation for venipuncture varies and the actual execution is unpredictable. The patients with tiny, deep veins are the most difficult, the difficulty increasing with each subsequent sample. The average time for this procedure is five minutes; with difficult veins, it can be ten minutes or more. The blood glucose level is rising as the patient absorbs the glucose dose and the initial blood samples are tracking this rise in order to establish the peak level. The rest of the samples are establishing their pattern and the rate of the fall to the initial level. Therefore, the blood glucose levels at the specified sample points are critical to the diagnostic interpretation of the curve. The resultant erratic pattern, inevitable in the collection of the blood samples, could significantly influence the interpretation of the curve. Therefore, making a note of this additional time at the completion of each collection, and using that information to construct a corrected curve, is mandatory for accurate results. The corrected curve is compromised unless the integrity of the time increments of the basic curve is rigidly controlled.

SUMMARY OF THE INVENTION

The Programmed Multi Time Interval Pin, the present invention, is designed to accurately measure hourly and ½ hourly intervals in such a way that all of the time increments are sequentially related and all refer to the same zero starting point. This is accomplished by dividing the two hour timing cycle of the timer into two sections, Pin #1 measuring the odd hours and Pin #2 measuring the even hours. Pin #1 begins its timing cycle at the uneven hour of 1 and after reaching zero, will increase by 2 hour increments 1+2=3, 3+2=5, etc. until removed. Pin #2 begins its timing cycle at the even hour of 2, increases by two hour increments 2+2=4, 4+2=6, etc. until removed. Pin #3 measures the even ½ hour intervals, starting at ½ hr., increasing in two hour increments to show ½+2=2½, 2½+2=4½, etc., until removed. Pin #4 measures the odd ½ hr. intervals by starting at 1½ hrs. and increasing in 2 hour increments to show 1½+2=3½, 3½+2=5½ hr, etc. until removed.

The Programmed Multi Time Interval Pin has a cap affixed to its top which can be rotated to show all the intervals, while the pin remains in the timing disc. The Programmed Multi-Time Interval Pins are produced in four separate models. Pin #1 shows all of the uneven time intervals by sequentially rotating its dial to show 1 hr, 3 hrs or 5 hrs. Pin #2 shows all of the even intervals by sequentially rotating the dial to show F, 2 hrs, 4 hrs or 6 hrs. The F is used to count down and unknown variable number, even past the start of a 2 hr. interval. Pin #3 rotates to show ½ hr. 2½ hr, 4½ hr. or 6½ hr. Pin #4 rotates to show 1½ hr, 3½ hr, or 5½ hr. When these four pins are inserted into the timing disc simultaneously, they are sequentially related, all referring to the same zero point.

The set of four pins are produced in four separate colors, namely red, yellow, blue, and green, so that one phlebotomist can process four patients at one session efficiently. These pins function independently without reference to the Monitor Panel. The color coded cap identifies the patient and the dial indicates the specimen time interval.

The system is very flexible. By simply increasing the range of cap colors, more patients can be processed. By providing additional time intervals to the labels under the caps, more sample collection times can be programmed. For example the sequential time intervals could be ½, 1, 1½, 2, 2½, 3, 3½, 4, 4½, 5, 5½, 6, etc. The system could be adapted to other similar timing applications by changing the basic time unit.

Accordingly, several objects and advantages of the invention are as follows. The Programmed Multi Time Interval Pin has a dial affixed to its top which can be rotated to show a sequence of time intervals without being removed from the timing disc. There are four different types, Pin #1 rotates to show 1 hr., 3 hr., or 5 hr., Pin #2 rotates to show F, 2 hr., 4 hr or 6 hr; Pin #3 rotates to show ½ hr, 2½ hr or 4½ hr; Pin #4 rotates to show 1½ hr., 3½ hr., or 5½ hr.

There are many advantages to this four pin system; it can be used to monitor many different timing requirements. For example, Pin #2 (f) can be inserted initially, to program any pre-sequential increment required, and remaining seated, cap is rotated to monitor a 2 hr interval. Pin #2 (f) can also be used to count down a variable interval past the start of a two hour time measurement. When inserted simultaneously, pin #1 at 60' and Pin #2 at 120' and the dials rotated as they reach the zero position, hourly intervals are measured until removed. Pins #3 & #4, the ½ hr. pins, can be inserted between the hourly pins for continuous monitoring, or removed, changing to hourly measurements. Examples showing the application of all four Programmed Multi Time Interval. Pins when used to select hourly and ½ hourly sequentially related intervals, all referring to the same zero starting point, are shown in FIG. 9.

The major advantage of the Programmed Multi Time Interval Pin, one that the Single Interval Pin is unable to provide, is its ability to automatically lock all the sequentially related sample points together so that they all refer to the same zero starting point. This is the basic requirement for providing an accurate and diagnostically correct interpretation. Another important advantage of the Programmed Multi Time Interval Pins is to be able to monitor the assimilation of the glucose loading dose, which again, the Single Interval Pin is unable to monitor. Even though the Single Interval Pin is able to show additional elapsed time, it cannot count it and monitor the next interval at the same time, the way that the Programmed Multi Time Interval Pin can.

The Programmed Multi Time Interval Pins system is very flexible. By simply increasing the range of cap colors, more patients can be processed. By providing additional time intervals on the labels, more collection times can be programmed. The system could be adapted to other similar timing applications by changing the basic time unit.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIGS. 1 and 2. Sheet two contains FIGS. 3 and 4. Sheet three contains FIGS. 5, 6 and 7.

FIG. 1 is a front isometric view of a prior art time interval indicator.

FIG. 2 is a side isometric view of a prior art single time interval pin.

FIG. 3 is a side isometric view of a multi time interval pin.

FIG. 4 is a side cross-sectional view of multi time interval pin.

FIG. 5 is a bottom quarter isometric view of a cap.

FIG. 6 is a top view of a label.

FIG. 7 is a top view of a label.

DETAILED DESCRIPTION OF THE PREFERRED EMBODIMENT

FIG. 3 is a side isometric view of multi time interval pin 6. Multi time interval pin 6 comprises cap 1 rotatably attached to carrier base 3, label 2 affixed to carrier base 3, and pin 4 rigidly attached to carrier base 3.

Carrier base 3 comprises carrier base upper surface 14 having carrier base top edge 15. In the preferred embodiment, carrier base top edge 15 was circumferencially disposed on carrier base upper surface 14. Label 2 is attached to carrier base upper surface 14.

Carrier base 3 further comprises carrier base lower surface 24. In the preferred embodiment, carrier base lower surface 24 was roughly parallel to carrier base upper surface 14. Carrier base projection 16 is rigidly attached to carrier base 3, and extends from carrier base lower surface 24 approximately perpendicular to carrier base lower surface 24. Pin 4 is rigidly attached to carrier base 3 at carrier base lower surface 24, and extends from carrier base lower surface 24 approximately perpendicular to carrier base lower surface 24. The extreme of pin 4 opposite carrier base 3 is a pin rounded end 18.

Anti-rotation notch 19 is defined by carrier base projection 16, carrier base lower surface 24, and pin 4. When multi time interval pin 6 is installed on a timer disc 30, pin 4 is inserted into a disc hole 32 until carrier base lower surface 24 butts against timer disc 30, and carrier base projection 16 hangs over an edge of timer disc 30. Thus that portion of timer disc 30 between disc hole 32 and the nearest edge of timer disc 30 resides within anti-rotation notch 19, thereby preventing the rotation of multi time interval pin 6 about pin 4 relative to timer disc 30. This is an especially important feature because when cap 1 is rotated, multi time interval pin 6 is also urged to rotate due to the snap fit between cap 1 and carrier base 3.

As may be observed in FIGS. 4 and 5, cap 1 comprises cap bore 20 sized to frictionally admit carrier base upper surface 14. Cap bore 20 comprises cap bore groove 22, which is sized to snap onto carrier base top edge 15. Window 10 provides an optical path through cap 1 such that indicia 8 on label upper surface 12 may be visible through window 10 when cap 1 is installed on carrier base upper surface 14. The frictional nature of the engagement between cap bore groove 22 and carrier base top edge 15 encourages cap 1 to remain in a constant angular orientation relative to carrier base 3. Cap 1 may further comprise cap edge serrations 9 disposed on cap edge 11 to facilitate rotating cap 1 relative to carrier base 3.

FIGS. 6 and 7 are top views of label 2. Label 2 contains indicia 8 which are visible through window 10 when cap 1 is in the correct angular relationship with carrier base 3. Since label 2 is affixed to carrier base upper surface 14, any rotation of cap 1 relative to carrier base 3 also constitutes rotation of cap 1 relative to label 2. Due to the frictional fit between cap 1 and carrier base 3, once window 10 has been positioned over a particular label 2 character, that character will tend to remain visible through window 10 until cap 1 is rotated manually relative to carrier base 3.

Operation

Multi time interval pin 6 is inserted into a disc hole 32 of timer disc 30 by placing pin 4 into disc hole 32, and allowing carrier base projection 16 to slide over an edge of timer disc 30. In this fashion multi time interval pin 6 is prevented from rotating about pin 4 relative to disc 30. Cap 1 is rotated relative to carrier base 3 until the correct number to show the time increment being measured is visible through window 10. At the completion of the measurement, multi time interval pin 6 may remain in place to measure an additional two hour increment. In this case, cap 1 is rotated to show the total elapsed time increment.

For example, with a first multi time interval pin 6, the first measurement is for 1 hr., the second will be for 3 hrs. (1+2=3), and the third for 5 hrs. (3+2=5). The label 2 with appropriate indicia 8 for such a first multi time interval pin 6 is illustrated in FIG. 6.

As a second example, with a second multi time interval pin 6, a 5 minute count down may be desired. In this case, the second multi time interval pin 6 is inserted at the 5 minute mark for the count down. Upon reaching zero, it starts counting a 2 hr. increment, and when the entire variable count down is completed, the elapsed time is added to the initial 5 minutes, so cap 1 is rotated until the number 2 is visible to indicate the 2 hour increment. The next increment will be 2+2=4. The label 2 with appropriate indicia 8 for such a second multi time interval pin 6 is illustrated in FIG. 7.

While a preferred embodiment of the invention has been illustrated herein, it is to be understood that changes and variations may be made by those skilled in the art without departing from the spirit of the appending claims.

DRAWING ITEM INDEX

1 cap
2 label
3 carrier base
4 pin
6 multi time interval pin
8 indicia
9 cap edge serrations
10 window
11 cap edge
12 label upper surface
14 carrier base upper surface
15 carrier base top edge
16 carrier base projection
18 pin rounded end
19 anti-rotation notch
20 cap bore
22 cap bore groove
24 carrier base lower surface
30 timer disc
32 disc hole
34 single interval pin

I claim:

1. A timing device comprising:

an instrument case comprising a disc rotatably mounted thereto, a scale on said instrument case visible through said disc, said disc comprising a plurality of disc holes, an electrical signal circuit including switch means and signal means connected to be energized upon activation of said switch means, said switch means being normally biased to a position rendering said signal means inoperative, and switch actuation means removably carried by said disc in selected ones of said holes for sequentially operating said switch means to render said signal operative to signal elapsed time; and said switch actuation means comprises at least one multi time interval pin having a cap rotatably attached to a carrier base and a carrier base projection extending over an edge of said disc whereby said multi time interval pin is prevented from rotating relative to said disc when said cap is rotated relative to said carrier base, said cap comprising a window wherethrough indicia on said carrier base is visible.

2. The timing device of claim 1 further comprising a pin rigidly attached to said multi time interval pin.

3. The timing device of claim 2 wherein said carrier base further comprises a carrier base lower surface, said pin being rigidly attached to said carrier base lower surface and said carrier base projection extending from said carrier base lower surface.

4. The multi time interval pin of claim 3 wherein said pin extends perpendicularly from said carrier base lower surface and said carrier base projection extends perpendicularly from said carrier base lower surface, said pin and said barrier base projection being parallel.

* * * * *